US005161380A

United States Patent [19]

Cheung

[11] Patent Number: 5,161,380

[45] Date of Patent: Nov. 10, 1992

[54] CRYOGENIC RECTIFICATION SYSTEM FOR ENHANCED ARGON PRODUCTION

[75] Inventor: Harry Cheung, Williamsville, N.Y.

[73] Assignee: Union Carbide Industrial Gases Technology Corporation, Danbury, Conn.

[21] Appl. No.: 743,734

[22] Filed: Aug. 12, 1991

[51] Int. Cl.[5] ..... F25J 3/04; F25J 3/06

[52] U.S. Cl. ..... 62/22; 62/18; 62/23; 62/24

[58] Field of Search ..... 62/18, 22, 24, 23

[56] References Cited

U.S. PATENT DOCUMENTS

| | | | |
|---|---|---|---|
| 2,700,282 | 1/1955 | Roberts | 62/22 |
| 2,817,216 | 12/1957 | Etienne | 62/22 |
| 4,137,056 | 1/1979 | Golovko | 62/22 X |
| 4,433,990 | 2/1984 | Olszewski | 62/22 |
| 4,783,208 | 11/1988 | Rathbone | 62/22 |
| 4,790,866 | 12/1988 | Rathbone | 62/22 |
| 4,822,395 | 4/1989 | Cheung | 62/22 |
| 4,836,836 | 6/1989 | Bennett et al. | 62/22 |
| 4,838,913 | 6/1989 | Victor et al. | 62/22 |
| 4,871,382 | 10/1989 | Thorogood et al. | 62/18 |
| 4,935,044 | 6/1990 | Schoenpflug | 62/22 |
| 5,019,144 | 5/1991 | Victor et al. | 62/22 |
| 5,019,145 | 5/1991 | Rohde et al. | 62/22 |
| 5,034,043 | 7/1991 | Rottmann | 62/22 |
| 5,049,173 | 9/1991 | Cormier, Sr. et al. | 62/22 X |
| 5,076,823 | 12/1991 | Hansel et al. | 62/22 |

*Primary Examiner*—Henry A. Bennet
*Assistant Examiner*—Christopher B. Kilner
*Attorney, Agent, or Firm*—Stanley Ktorides

[57] ABSTRACT

A cryogenic rectification system comprising two cryogenic rectification plants wherein a fluid mixture comprising argon and nitrogen is withdrawn in a defined manner from the first plant and passed into the second plant such that argon production is enhanced to more than offset the additional separation power requirements.

15 Claims, 2 Drawing Sheets 60
21
2000
V
V
58
66
62
57
65
67
59
500
300
63
61
53
64
54
52
55
400
7
68
51
56
69

CRYOGENIC RECTIFICATION SYSTEM FOR ENHANCED ARGON PRODUCTION

TECHNICAL FIELD

This invention relates generally to cryogenic rectification of fluid mixtures comprising oxygen, nitrogen and argon, e.g. air, and, more particularly, to cryogenic rectification for the production of argon.

BACKGROUND ART

Argon is becoming increasingly more important for use in many industrial applications such as in the production of stainless steel, in the electronics industry, and in reactive metal production such as titanium processing.

Argon is generally produced by the cryogenic rectification of air. Air contains about 78 percent nitrogen, 21 percent oxygen and less than 1 percent argon. Because the argon concentration in air is relatively low, it is recovered as a co-product in conjunction with the recovery of the major air components. In order for argon recovery to be economical, the air separation plant must be of relatively large size, generally of a size of about at least 50 tons per day oxygen capacity. It would be desirable to have a cryogenic rectification system which can enable the economical recovery of argon from air separation plants of any size, particularly those having a capacity of less than 50 tons per day of oxygen.

Many air separation plants are built without the capability of producing argon because often there is initially a demand for oxygen or oxygen and some nitrogen without a corresponding demand for argon. When argon demand later develops, it may be difficult to retrofit the plant to produce argon and, thus, a new plant is built, often at a greater capacity, to replace the original plant and to produce argon. It would be desirable to have a cryogenic rectification system which can enable one to effectively recover argon processed in an air separation plant which does not have an argon column.

Accordingly, it is an object of this invention to provide a cryogenic rectification system which will enable one to effectively recover argon processed in a cryogenic air separation plant having a capacity which may be less than 50 tons per day of oxygen.

It is another object of this invention to provide a cryogenic rectification system which will enable one to effectively recover argon processed in a cryogenic rectification plant which does not have an argon column.

SUMMARY OF THE INVENTION

The above and other objects which will become apparent to one skilled in the art upon a reading of this disclosure are attained by the present invention, one aspect of which is:

Cryogenic rectification method for enhanced argon production comprising:

(A) providing a feed comprising oxygen, nitrogen and argon into a first cryogenic rectification plant comprising a first column and a second column;

(B) separating the feed in the first column by cryogenic rectification into nitrogen-enriched fluid and oxygen-enriched fluid;

(C) providing nitrogen-enriched fluid and oxygen-enriched fluid produced in the first column into the second column and separating the fluids provided into the second column by cryogenic rectification into nitrogen-rich fluid and oxygen-rich fluid;

(D) withdrawing nitrogen-rich fluid from the second column at a point above the point where oxygen-enriched fluid is provided into the second column;

(E) withdrawing a fluid mixture comprising nitrogen and argon from the second column at a point between the points where nitrogen-rich fluid is withdrawn from the second column and oxygen-enriched fluid is provided into the second column; and (F) passing the fluid mixture comprising nitrogen and argon withdrawn from the second column into a second cryogenic rectification plant comprising an argon column.

Another aspect of this invention is:

Cryogenic rectification apparatus for enhanced argon production comprising:

(A) a first cryogenic rectification plant comprising a first column and a second column and means for providing a feed into the first column;

(B) means for passing fluid from the lower portion of the first column into the second column;

(C) means for withdrawing fluid from the upper portion of the second column at a point above the point where said fluid from the lower portion of the first column is passed into the second column;

(D) intermediate passage means for withdrawing fluid from the second column at a point between the points where said fluid from the lower portion of the first column is passed into the second column and where said fluid is withdrawn from the upper portion of the second column; and (E) a second cryogenic rectification plant comprising an argon column and means for providing fluid withdrawn from the second column by the intermediate passage means into the second cryogenic rectification plant.

As used herein the term, "column", means a distillation or fractionation column or zone, i.e., a contacting column or zone wherein liquid and vapor phases are countercurrently contacted to effect separation of a fluid mixture, as for example, by contacting of the vapor and liquid phases on a series or vertically spaced trays or plates mounted within the column and/or on packing elements which may be structured packing and/or random packing elements. For a further discussion of distillation columns, see the Chemical Engineers' Handbook, fifth edition, edited by R. R. Perry and C. H. Chilton, McGraw-Hill Book Company, New York, Section 13, "Distillation" B. D. Smith, et al., page 13-3, *The Continuous Distillation Process.* The term, double column is used to mean a higher pressure column having its upper end in heat exchange relation with the lower end of a lower pressure column. A further discussion of double columns appears in Ruheman "The Separation of Gases" Oxford University Press, 1949, Chapter VII, Commercial Air Separation.

Vapor and liquid contacting separation processes depend on the difference in vapor pressures for the components. The high vapor pressure (or more volatile or low boiling) component will tend to concentrate in the vapor phase whereas the low vapor pressure (or less volatile or high boiling) component will tend to concentrate in the liquid phase. Partial condensation is the separation process whereby cooling of a vapor mixture can be used to concentrate the volatile components(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases is adiabatic and can include integral or differential contact between the phases. Separation process arrangements that utilize the principles of rectification to separate mixtures are often interchangeably termed rectification columns, distillation columns, or fractionation columns. Cryogenic rectification is a rectification process carried out at temperatures at or below 123 degrees Kelvin.

As used herein the term "indirect heat exchange" means the bringing of two fluid streams into heat exchange relation without any physical contact or intermixing of the fluids with each other.

As used herein the term "argon column" means a column which processes a feed comprising argon and produces a product having an argon concentration which exceeds that of the feed.

As used herein the term "equilibrium stage" means a contact process between vapor and liquid such that the exiting vapor and liquid streams are in equilibrium.

As used herein the term "cryogenic rectification plant" means a plant wherein separation by vapor/liquid contact is carried out at a temperature at or below 123 degrees Kelvin while other auxiliary process components or equipment may be above this temperature.

DETAILED DESCRIPTION

The invention will be described in detail with reference to the Drawings.

Figure 1:
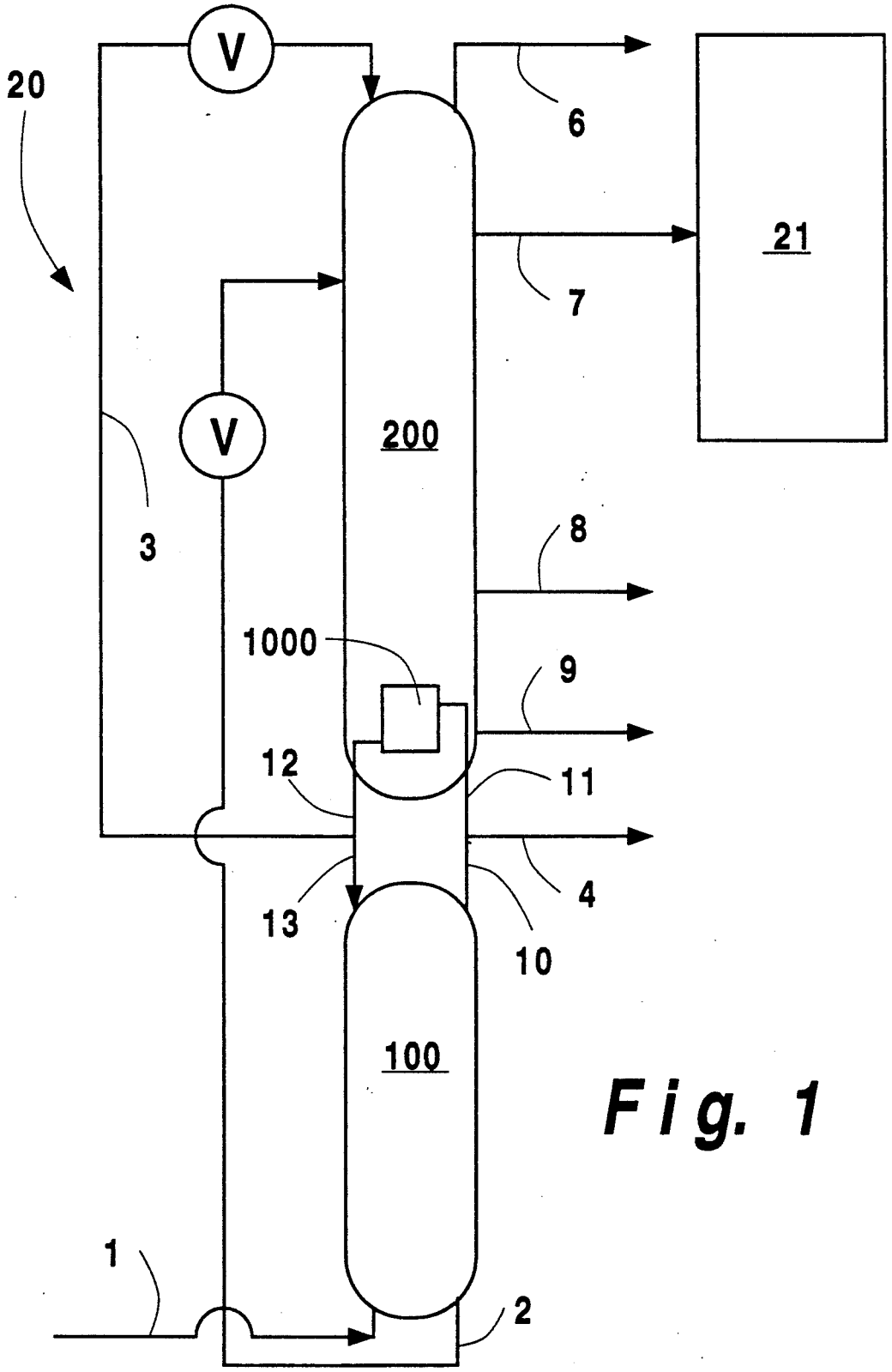
FIG. 1 is a schematic representation of one preferred embodiment of the first cryogenic rectification plant useful in the practice of this invention.

Referring now to FIG. 1, feed 1 comprising oxygen, nitrogen and argon, e.g. air, is provided into first column 100 of first cryogenic rectification plant 20. In the embodiment illustrated in FIG. 1, first cryogenic rectification plant 20 comprises a double column system comprising a higher pressure column 100 and a lower pressure column 200. Higher pressure column 100 is operating at a pressure generally within the range of from 60 to 180 pounds per square inch absolute (psia). Within first column 100 the feed is separated by cryogenic rectification into nitrogen-enriched fluid and oxygen-enriched fluid.

Nitrogen-enriched fluid is withdrawn from first column 100 as vapor stream 10. A portion 4 may be recovered as high pressure nitrogen gas or liquefied to produce liquid nitrogen product. The remaining portion 11 is provided into main condenser 1000 of the double column system wherein it is liquefied by indirect heat exchange with reboiling column 200 bottoms. Resulting liquid 12 is then divided into portion 3 and portion 13. Portion 13 is passed back into first column 100 as reflux and portion 3 is passed into the upper portion of second column 200 as reflux. In the embodiment illustrated in FIG. 1 second column 200 is the lower pressure column of the double column system of first cryogenic rectification plant 20. Second column 200 is operating at a pressure less than that of first column 100 and generally within the range of from 12 to 45 psia.

Oxygen-enriched fluid is passed as liquid stream 2 taken from the lower portion of first column 100 into second column 200. As used herein the terms "upper portion" and "lower portion" mean respectively the upper half and the lower half of the height of a column. The preferred upper portion is that portion of the column above all the equilibrium stages of the column and the preferred lower portion of the column is that portion of the column below all the equilibrium stages of the column.

Within second column 200 the nitrogen-enriched fluid and the oxygen-enriched fluid which are provided into the column are separated by cryogenic rectification into nitrogen-rich fluid and oxygen-rich fluid. Oxygen-rich fluid may be withdrawn from column 100 as liquid stream 9 and recovered as product liquid oxygen. Alternatively or in addition, oxygen-rich fluid which was vaporized at the bottom of second column 200 against condensing nitrogen-enriched vapor as was previously described may be recovered as gaseous oxygen product which may be withdrawn from second column 200 through conduit 8. Generally the oxygen concentration of the oxygen product will exceed 99 percent.

Nitrogen-rich fluid is withdrawn from the upper portion of second column 200 as vapor stream 6 and may be recovered as product nitrogen having a nitrogen concentration of at least 99.9 percent. The nitrogen-rich fluid is withdrawn from the upper portion of the second column at a point above the point where the oxygen-enriched liquid is passed into second column 200 as stream 2.

Between the points where nitrogen-rich fluid is withdrawn from second column 200 as stream 6 and where oxygen-enriched fluid is provided into second column 200 as stream 2 there is withdrawn from second column 200 through intermediate passage means 7 a fluid mixture comprising nitrogen and argon. Preferably the fluid mixture in stream 7 will have an argon concentration which is at least five times, and most preferably at least ten times, the argon concentration in feed 1. Generally, the argon concentration of stream 7 will be within the range of from about 5 to 20 percent and the nitrogen concentration of stream 7 will be within the range of from about 75 to 95 percent. Stream 7 may also generally contain some oxygen in a concentration within the range of from 0.1 to 7 percent. There will be sufficient equilibrium stages in second column 200 between the nitrogen-rich fluid withdrawal point in stream 6 and the oxygen-enriched fluid introduction point in stream 2 to enable the attainment of the suitable argon concentration in withdrawn stream 7. The molar flowrate of the withdrawn argon-containing stream in intermedidate passage means 7 will preferably be less than 15 percent and most preferably less than 8 percent of the molar flowrate of feed stream 1 into first column 100.

Figure 2:
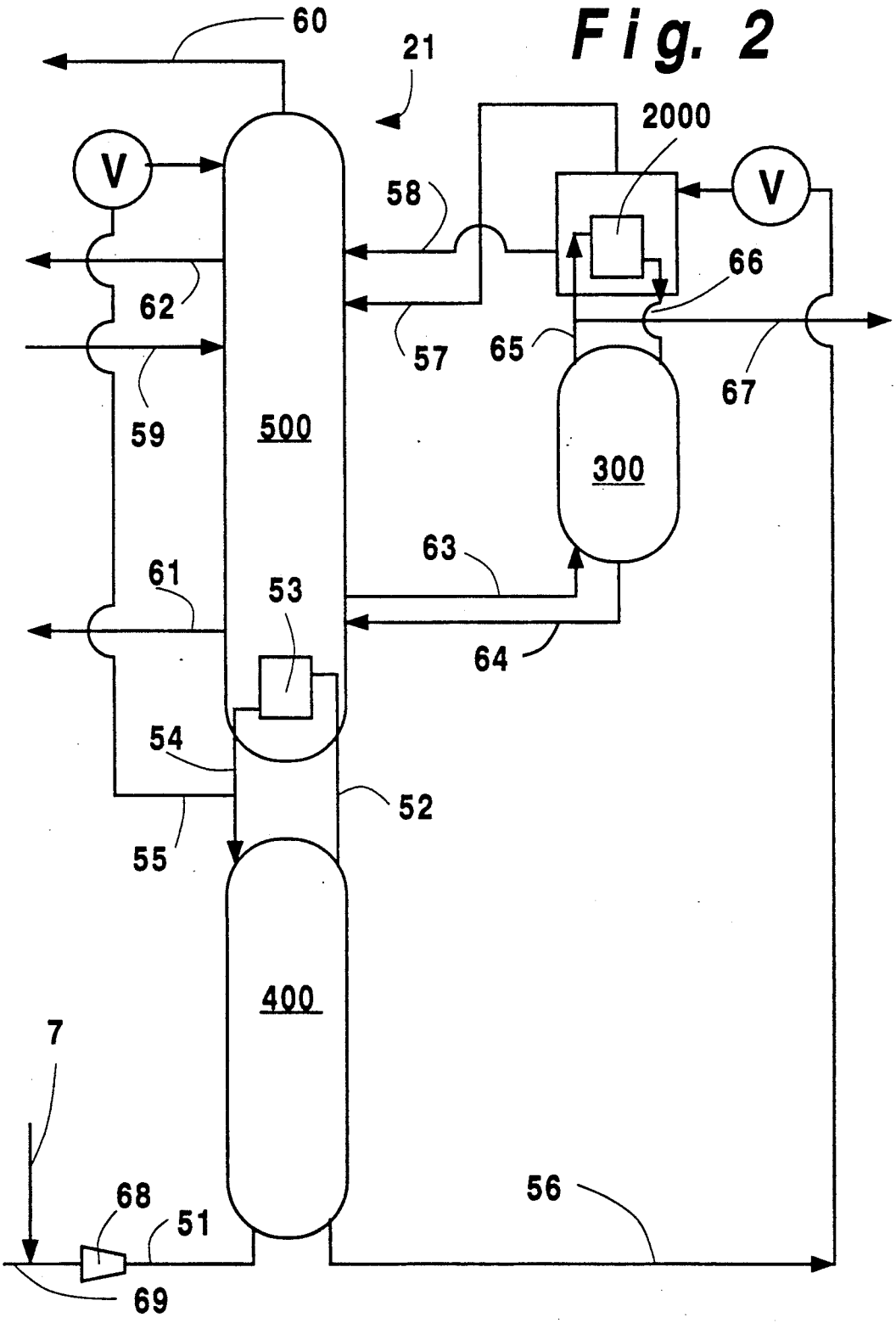
FIG. 2 is a schematic representation of one preferred embodiment of the second cryogenic rectification plant useful in the practice of this invention.

Argon-containing fluid withdrawn in stream 7 is passed into a second cryogenic rectification plant 21 which comprises an argon column. Second cryogenic rectification plant 21 is illustrated in FIG. 1 as representative box 21. A more detailed schematic representation of one preferred embodiment of the second rectification plant suitable for use with this invention is illustrated in FIG. 2. Although the Figures illustrate the case where the first and second cryogenic rectification plants are situated close to one another, it will be appreciated that these two plants can be at a distance from one another, and the argon/nitrogen mixture may be transported, e.g. by truck, from the first plant to the second plant.

Referring now to FIG. 2 there is illustrated second cryogenic rectification plant 21 which comprises argon column 300. In the preferred embodiment illustrated in FIG. 2 second cryogenic rectification plant 21 comprises a double column in addition to argon column 300. The double column has higher pressure column 400 and lower pressure column 500. A number of cryogenic rectification plants having an argon column may be employed as the second cryogenic rectification plant of this invention. By way of example, one may employ the plant described in U.S. Pat. No. 4,822,395 or U.S. Pat. No. 5,019,144.

The argon/nitrogen fluid mixture taken from the second column of the first cryogenic rectification plant may be passed into the second cryogenic rectification plant in a number of ways. For example, the subject fluid mixture may be provided into the turbine discharge stream and fed into the lower pressure column, or it may be warmed, compressed, desuperheated and inserted into the higher pressure column, or it may be liquefied and inserted into the kettle liquid which is passed into the lower pressure column, or it may be liquefied and a portion of the liquid may be passed into the lower pressure column and a portion may be passed into the higher pressure column. Preferably, the argon/-nitrogen fluid mixture is warmed and then fed into the main compressor suction for the second cryogenic rectification plant.

Referring back to FIG. 2, the argon/nitrogen fluid mixture 7 is combined with air 69, such as at the suction end of the feed air compressor 68, and the combined feed 51 is passed into high pressure column 400 which is operating at a pressure generally within the range of from 60 to 180 psia. A minor portion of the feed may be expanded in a turbine to provide refrigeration and introduced into lower pressure column 500 such as in stream 59. Top vapor 52 is passed into main condenser 53 and condensed against reboiling column 500 bottoms. Resulting liquid 54 is passed into column 400 as reflux. A portion 55 of liquid 54 is passed into column 500 as reflux. Kettle liquid is withdrawn from column 400 as stream 56 and passed into argon column top condenser 2000 wherein it is partially vaporized by indirect heat exchange with argon column top vapor. Resulting vapor and remaining liquid from this partial vaporization are passed into column 500 as streams 57 and 58, respectively. The feeds into column 500 are separated by cryogenic rectification into nitrogen product which is recovered in stream 60 and oxygen product which is recovered in stream 61. A waste stream 62 is also removed from column 500.

A stream 63 comprising oxygen and argon with less than 1 percent nitrogen is passed from column 500 into argon column 300 wherein it is separated by cryogenic rectification into argon-enriched fluid and oxygen bottom liquid which is passed back into column 500 as stream 64. Argon-enriched fluid is passed as stream 65 into top condenser 2000 wherein it is condensed and returned as stream 66 into argon column 300. Argon product is recovered from the argon column either as argon vapor stream 67 as illustrated in FIG. 2 and/or as an argon liquid stream taken from the top condenser or off stream 66. The argon product will have an argon concentration of at least 90 percent and generally will have an argon concentration of at least 95 percent.

As mentioned, the main feed into the second cryogenic rectification plant is air. At first glance, it may appear to be disadvantageous to provide the argon/nitrogen mixture taken from the second column of the first cryogenic rectification plant into the second cryogenic rectification plant since this has the effect of diluting the argon in the argon/nitrogen mixture and requiring that cryogenic rectification be carried out again to separate this argon. However, despite the dilution of the argon in the argon/nitrogen mixture, it has been found that the argon increment to the second cryogenic rectification plant enables one to provide a feed stream into the argon column of the second cryogenic rectification plant having an argon concentration which exceeds that normally available. This enables one to reduce the argon column feed rate into the column and to reduce the size of the argon column resulting in both reduced capital and reduced operating costs for comparable argon recovery. This more than compensates for the increased separation energy required to reseparate the diluted argon in the argon/nitrogen mixture passed into the second cryogenic rectification plant.

The following example is provided for illustrative purposes and is not intended to be limiting. Air at a flowrate of 1,053,700 cubic feet per hour at normal temperature and pressure (cfh) and at a pressure of about 86 psia is passed into the higher pressure column of a first cryogenic rectification plant similar to that illustrated in FIG. 1. A stream comprising 12.64 percent argon, 83.36 percent nitrogen and 4 percent oxygen is withdrawn from the lower pressure column as stream 7 at a pressure of 17.5 psia and at a flowrate of 68,105 cfh. The lower pressure column has 73 equilibrium stages and the higher pressure column has 42 equilibrium stages. There are 14 equilibrium stages between the nitrogen-rich fluid withdrawal point and the argon/nitrogen mixture withdrawal point and a further 13 equilibrium stages between the argon/nitrogen mixture withdrawal point and the oxygen-enriched liquid introduction point.

The argon/nitrogen fluid mixture withdrawn from the second or lower pressure column is mixed with feed air in the suction of the compressor for a three column air separation plant similar to that illustrated in FIG. 2. The feed is passed into the higher pressure column at a rate of 1,172,932 cfh at a pressure of about 72 psia. Argon product is recovered from the argon column at a flowrate of 16,500 cfh having a composition of 97.7 percent argon, 0.38 percent nitrogen and 1.92 percent oxygen. This argon product flowrate is 5750 cfh greater than that which is attained by operating the second cryogenic rectification with only a conventional air feed. This increased product production more than makes up for the increased power cost for carrying out the additional separation because, inter alia, argon has a greater marginal value than does oxygen.

In conventional practice when one desires to recover argon from an air separation operation, one concentrates the argon in an oxygen stream and this argon-/oxygen stream is then further processed to recover the argon. In contrast to conventional practice the invention concentrates the argon in nitrogen, not in oxygen, and further processes this argon/nitrogen mixture in the second cryogenic rectification plant. In this way, the oxygen production of the first plant is not compromised and overall oxygen and argon production from the entire two plant system is enhanced.

Now, by the use of the method and apparatus of this invention, one can effectively and efficiently recover argon processed in a cryogenic rectification plant which may be of a small size or for other reasons does not have an argon column associated with it.

Although the invention has been described in detail with reference to a certain preferred embodiment, those skilled in the art will recognize that there are other embodiments of the invention within the spirit and the scope of the claims.

I claim:

1. Cryogenic rectification method for enhanced argon production comprising:

(A) providing a feed comprising oxygen, nitrogen and argon into a first cryogenic rectification plant comprising a first column and a second column;

(B) separating the feed in the first column by cryogenic rectification into nitrogen-enriched fluid and oxygen-enriched fluid;

(C) providing nitrogen-enriched fluid and oxygen-enriched fluid produced in the first column into the second column and separating the fluids provided into the second column by cryogenic rectification into nitrogen-rich fluid and oxygen-rich fluid;

(D) withdrawing nitrogen-rich fluid from the second column at a point above the point where oxygen-enriched fluid is provided into the second column;

(E) withdrawing a fluid mixture comprising nitrogen and argon from the second column at a point between the points where nitrogen-rich fluid is withdrawn from the second column and oxygen-enriched fluid is provided into the second column; and (F) passing the fluid mixture comprising nitrogen and argon withdrawn from the second column into a second cryogenic rectification plant comprising an argon column.

2. The method of claim 1 wherein the feed is air.

3. The method of claim 1 wherein the argon concentration of the fluid mixture comprising nitrogen and argon is at least five times that of the argon concentration of the feed.

4. The method of claim 1 wherein the argon concentration of the fluid mixture comprising nitrogen and argon is at least ten times that of the argon concentration of the feed.

5. The method of claim 1 wherein the molar flowrate of the fluid mixture comprising nitrogen and argon withdrawn from the second column is less than 15 percent of the molar flowrate of the feed provided into the first column.

6. The method of claim 1 wherein the molar flowrate of the fluid mixture comprising nitrogen and argon withdrawn from the second column is less than 8 percent of the molar flowrate of the feed provided into the first column.

7. The method of claim 1 wherein the second cryogenic rectification plant comprises a double column having a higher pressure column and a lower pressure column, and fluid mixture comprising nitrogen and argon withdrawn from the second column is passed into the higher pressure column.

8. The method of claim 1 wherein the second cryogenic rectification plant comprises a double column having a higher pressure column and a lower pressure column, and fluid mixture comprising nitrogen and argon withdrawn from the second column is passed into the lower pressure column.

9. The method of claim 1 wherein the second cryogenic rectification plant comprises a double column having a higher pressure column and a lower pressure column, and fluid mixture comprising nitrogen and argon withdrawn from the second column is liquefied and thereafter passed into the lower pressure column.

10. The method of claim 1 wherein the second cryogenic rectification plant comprises a double column having a higher pressure column and a lower pressure column, and fluid mixture comprising nitrogen and argon withdrawn from the second column is liquefied and thereafter a first liquid portion thereof is passed into the lower pressure column and a second liquid portion thereof is passed into the higher pressure column.

11. The method of claim 1 further comprising recovering argon product from the argon column of the second cryogenic rectification plant having an argon concentration of at least 90 percent.

12. Cryogenic rectification apparatus for enhanced argon production comprising:

(A) a first cryogenic rectification plant comprising a first column and a second column and means for providing a feed into the first column;

(B) means for passing fluid from the lower portion of the first column into the second column;

(C) means for withdrawing fluid from the upper portion of the second column at a point above the point where said fluid from the lower portion of the first column is passed into the second column;

(D) intermediate passage means for withdrawing fluid from the second column at a point between the points where said fluid from the lower portion of the first column is passed into the second column and where said fluid is withdrawn from the upper portion of the second column; and (E) a second cryogenic rectification plant comprising an argon column and means for providing fluid withdrawn from the second column by the intermediate passage means into the second cryogenic rectification plant.

13. The apparatus of claim 12 wherein the second cryogenic rectification plant comprises a double column having a higher pressure column and a lower pressure column further comprising means wherein fluid withdrawn from the second column by the intermediate passage means is passed into the higher pressure column.

14. The apparatus of claim 12 wherein the second cryogenic rectification plant comprises a double column having a higher pressure column and a lower pressure column further comprising means wherein fluid withdrawn from the second column by the intermediate passage means is passed into the lower pressure column.

15. The apparatus of claim 12 wherein the second cryogenic rectification plant further comprises a main compressor and means wherein fluid withdrawn from the second column by the intermediate passage means is passed into the suction of the main compressor prior to being provided into the second cryogenic rectification plant.

* * * * *